United States Patent [19]

Badger et al.

[11] Patent Number: 4,817,334

[45] Date of Patent: Apr. 4, 1989

[54] WINDOW BAR SECURITY SYSTEM

[75] Inventors: Raymond B. Badger, Inglewood; Peter J. Schmitz; Arthur L. Thistle, both of Mississauga, all of Canada

[73] Assignee: Palladium Security Products (1985) Inc., Toronto, Canada

[21] Appl. No.: 700,197

[22] Filed: Feb. 11, 1985

[51] Int. Cl.[4] ..... E06B 3/68

[52] U.S. Cl. ..... 49/55; 49/56

[58] Field of Search ..... 49/50, 55, 56, 57; 160/225

[56] References Cited

U.S. PATENT DOCUMENTS

| | | | |
|---|---|---|---|
| 430,000 | 6/1890 | Clark et al. | 403/285 X |
| 2,819,500 | 1/1958 | Saber | 49/55 X |
| 4,026,070 | 5/1977 | Hicks | 49/55 |
| 4,358,910 | 11/1982 | Keating et al. | 49/56 |
| 4,394,805 | 7/1983 | Napper | 49/55 |

*Primary Examiner*—K. Downey

*Attorney, Agent, or Firm*—Sim & McBurney

[57] ABSTRACT

A window bar guard system for discouraging breaking and entry through a window is constructed of components which may be readily assembled and installed by the consumer. The grillwork for the window bar guard system includes a set of telescoping tubular steel bars. The telescoping bars permit the consumer to expand or retract the grillwork system to fit a desired window. Upon obtaining the proper size of the grillwork, the steel tubular bars are permanently secured together to provide a solid grillwork custom fitted for the particular window.

3 Claims, 4 Drawing Sheets

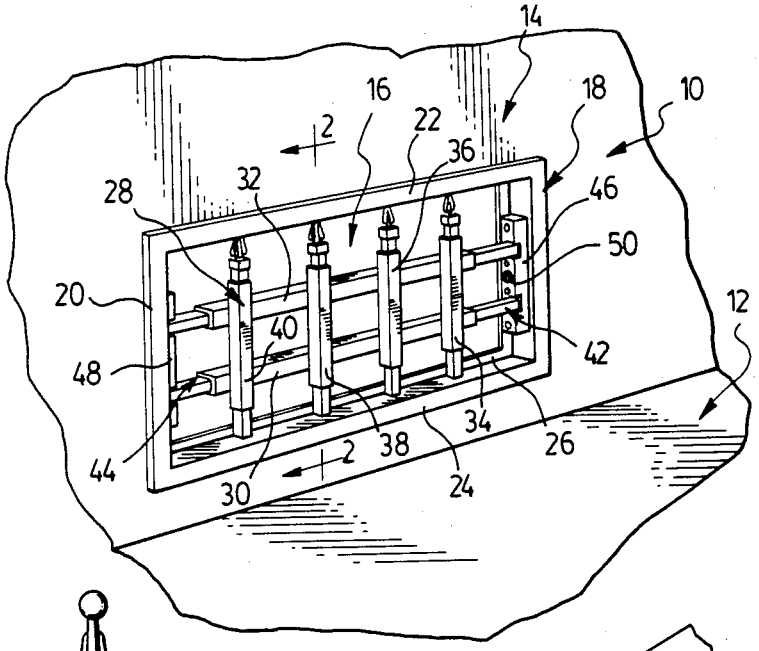
FIG.1.
FIG.2.
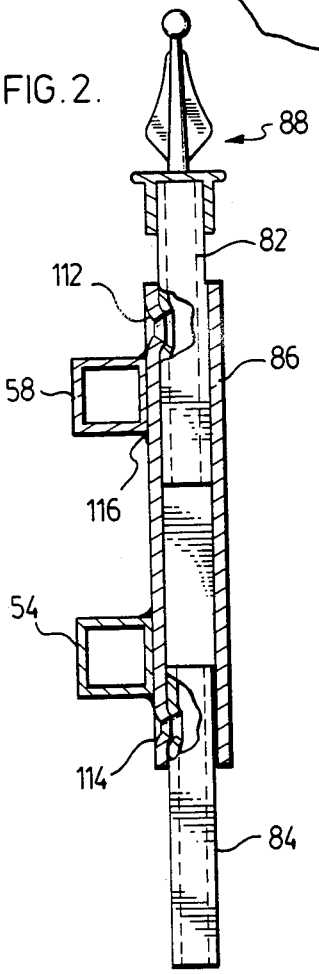
FIG.3.
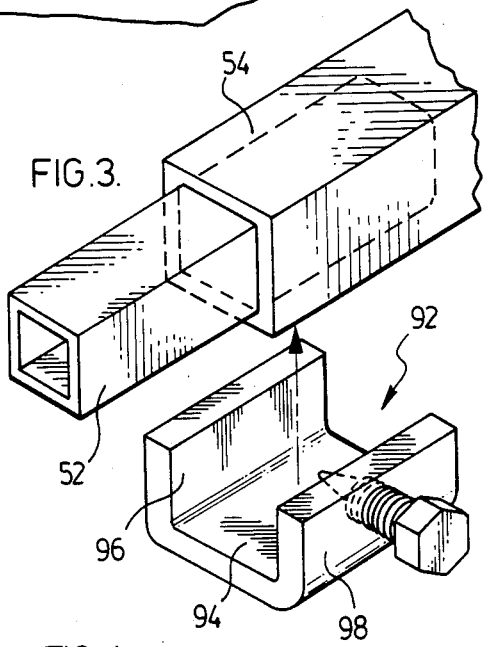
FIG.4.
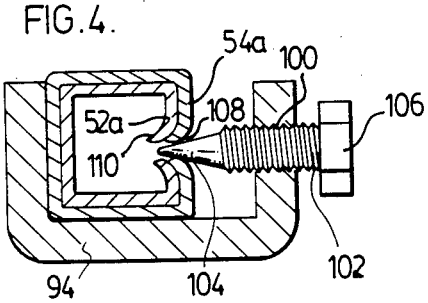

FIG. 12.
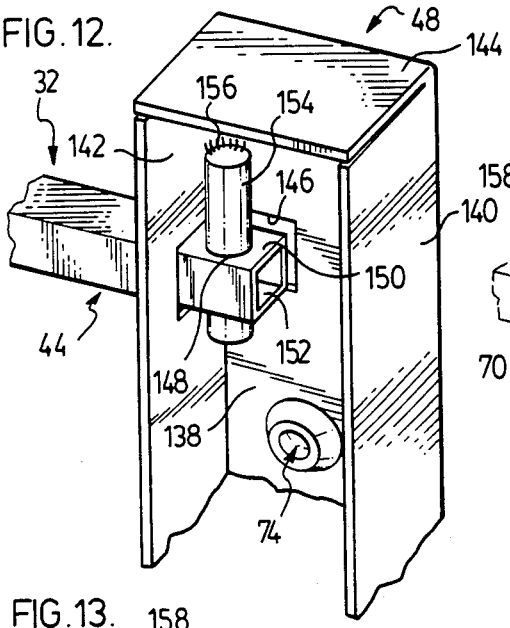
FIG. 11.
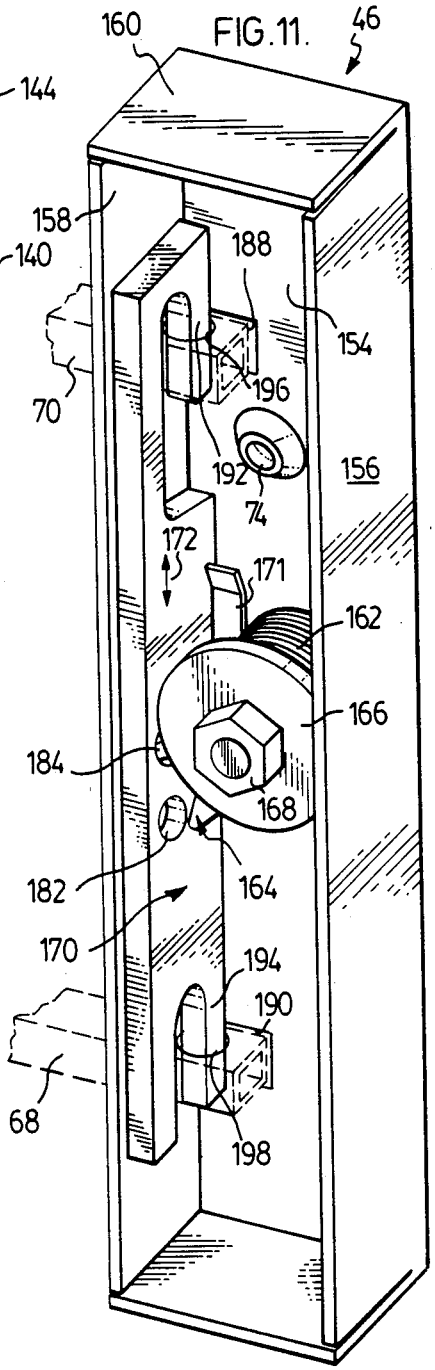
FIG. 13.
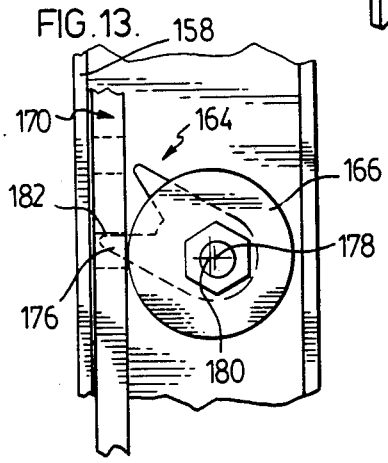
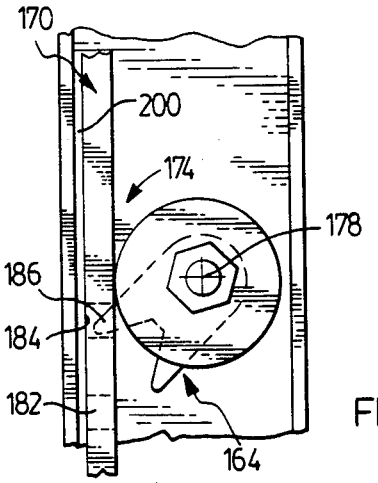
FIG. 14.

WINDOW BAR SECURITY SYSTEM

FIELD OF THE INVENTION

This invention relates to a window bar guard system for discouraging breaking and entry through window openings.

BACKGROUND OF THE INVENTION

Window bar guard systems have been used for some time in an effort to thwart or discourage breaking and entry into a house or other establishment through a window opening. A telescoping window bar guard system is disclosed in U.S. Pat. No. 3,38,062. The system includes two horizontal members having an extensible portion One side of the grillwork is pivotally connected to the window frame The extensible portion is extended and secured to the other side of the window frame by a lock arrangement In the event of fire or the need to clean the window, the system may be unlocked and swung outwardly. The extensible portion is not secured to the horizontal members so that the extensible portion can be retracted in order to release the bar system. Due to the free telescopic nature of the bars of the window system, prying with a crowbar can weaken the connection of either side of the bar guard system to the window frame to allow illegal entry through the window.

A telescopic bar window system, which entails locking the relative positions of the telescoping bars, is disclosed in U.S. Pat. No. 4,437,265. Lock portions are used on at least two of the telescoping horizontal bar members to prevent relative movement therebetween. The ends of the bars are fastened to the opposite sides of the window frame However, to remove the bar system from the window it is necessary to unlock the telescoped bars. The lock provided, in accordance with this patent, is a friction type lock which can be readily tampered with to release and thereby allow illegal entry to a building through the window.

Fixed bar arrangements for window bar guard systems are disclosed in U.S. Pat. Nos. 2,999,682, 2,222,667, 4,019,281 and 4,358,912. Due to the fixed nature of the bars, various mounting systems are employed to permit outward withdrawal of the bar gratings by complete removal or pivotal action. Pivotal action for the bar systems is further demonstrated in U.S. Pat. No. 3,953,939, where a lower segment of the bar system is pivoted upwardly when released.

SUMMARY OF THE INVENTION

According to an aspect of this invention, a window bar guard system for discouraging breaking and entry through a window comprises a bar grillwork having a plurality of spaced-apart first set of parallel bars and a plurality of interconnecting spaced-apart second set of parallel bars extending essentially perpendicular to and permanently secured to the first set of bars. The bar grillwork spans a window opening to block human entry through the grillwork. Means secures opposite ends of the plurality of first set of bars to corresponding structural portions defining opposing edges of a selected window opening Each of the bars of the first set of bars has a first tubular bar spanning a majority of the distance between the opposing window edges. A second tubular bar for telescopic insertion in an end portion of the first tubular bar is provided. The first and second tubular bars have mating cross-sections. The second tubular bars are operative for extended distances from within the first tubular bar of approximately the distance between spaced-apart bars of the second set. The second tubular bars are extended from the first tubular bars to span the remaining distance between the opposing window edges The second tubular bars are permanently secured to the first tubular bars after the first and second tubular bars are in their extended positions The first and second tubular bars are secured by means for permanently interconnecting adjacent wall portions of the first and second steel tubular bars.

According to another aspect of the invention, a method for installing a window bar guard system over a window opening to discourage breaking and entry through the window opening is contemplated. The window bar guard system includes a first set of a plurality of telescopic parallel bars and a second set of a plurality of parallel bars extending perpendicular to the first set of bars. The telescoping bars comprise an outer tubular bar and an inner tubular bar of mating cross-sections. Means is provided for securing end portions of the first set of bars to structural portions defining opposite edges of the window. The telescopic bars are extended or retracted to span the opposite edges of the window The telescopic bars which may be formed of steel or other suitable metal are pierced to form overlapping portions of the outer first tubular bar over said inner first tubular bar. The overlapping portions permanently secure the inner bar to the outer bar, fastening with non-removable fasteners the securing means at each end of the first set of bars to the structural portions.

BRIEF DESCRIPTION OF THE DRAWINGS

Preferred embodiments of the invention are shown in the drawings wherein:

FIG. 1 is a perspective view of the window bar guard system according to this invention as mounted in a window;

FIG. 2 is a section along the lines 2—2 of FIG. 1;

FIG. 3 illustrates the first step in piercing overlapping portions of telescopic bars of the bar system of FIG. 1;

FIG. 4 illustrated the last step in piercing the overlapping tubular bar portions to permanently secure them together;

FIG. 11 is a perspective view of the inside of the locking system of FIG. 10;

FIG. 12 is a perspective view of an upper portion of the bar guard securement device; and FIGS. 13 and 14 are rear plan views of the lock system of FIG. 11 showing the locked and unlocked positions.

DETAILED DESCRIPTION OF THE PREFERRED EMBODIMENTS

Figure 5:
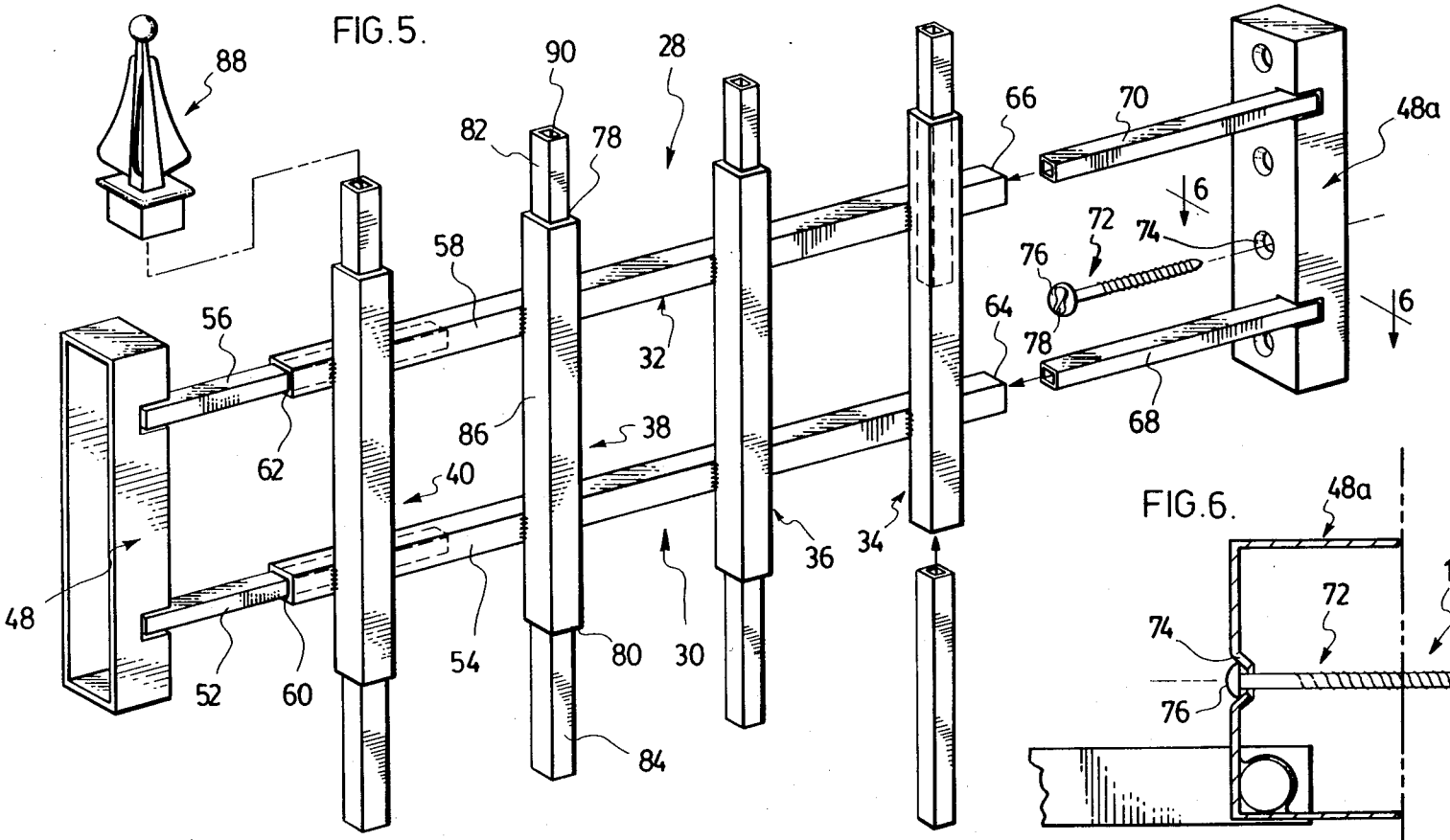
FIG. 5 is an exploded view of the window bar guard system of FIG. 1.

FIG. 1 illustrates the use of the window bar guard system, according to this invention, on a window commonly found in residential and commercial buildings. According to a preferred embodiment, the bar guard system is particularly adapted for use on basement windows in the building wall 10 adjacent ground level 12. It is appreciated that a majority of the break-ins to residence and commercial buildings is through basement or ground level windows at the rear of the building. The window 14 has an opening 16 defined by structural portions 18, 20, 22 and 24 of the building. These structural portions may be concrete in which the window frame 26 is set or they may be of wood which constitutes additional parts of the window frame.

The bar guard system 28, according to this invention, is installed in the window opening 16 to discourage breaking and entry through the window. The bar guard system 28 comprises a first set of spaced-apart parallel bars 30 and 32. In addition, the grillwork 28 comprises a second set of spaced-apart parallel bars 34, 36, 38 and 40. These bars extend in a direction essentially perpendicular to the direction of the first set of bars and are interconnected to form a grid pattern. The spacing between the first and second set of bars is such to prevent human passage between, over or under the bars and through the window opening 16. The end portions generally designated 42 and 44 of the first set of bars are secured to the building or window structural portions 18 and 20 by securing devices 46 and 48. The securing devices 46 include a lock 50 which, when unlocked, releases end portion 42 of the grillwork. The other end portion 44 is pivotally mounted in securing device 48 so that with the lock unlatched, the grill may be swung open to allow cleaning of the window and/or replacement. The lock 50 is of a type which is not easily pilfered to thwart burglars attempting to pick the lock and gain entry. Furthermore, the lock system is necessary in most residential areas due to fire regulations which require that the bars can be swung open to permit exit through the window in the event of fire.

Referring to FIG. 5, an alternative to the releasable bar grillwork mounting device 46 is shown in association with the grating 28. It is appreciated that some of the windows in a room may be protected by a grillwork which is permanently secured in place. Instead of releasable securing device 46, a permanent device **48*a* is used which is similar to device 48. In this embodiment, it is identical since inverting unit 48 provides unit 48*a***.

Figure 7:
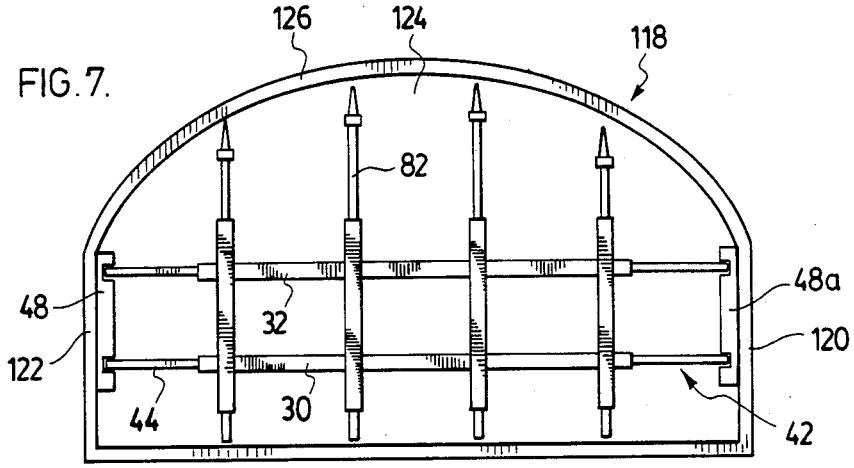
FIG. 7 illustrates another embodiment according to the invention for the window bar guard system.

The system, according to this invention, is devised in a manner to readily facilitate installation of the bar guard system by the householder. Since residential homes have a variety of window sizes, it is also necessary to reduce the number of stack items which must be sold to accommodate these varying window sizes. This is accomplished by the provision in the first set of bars 30 and 32 of telescopic portions provided by an inner tubular bar 52 telescoped within the outer tubular bar 54 and similarly with the second bar, the inner tubular bar 56 is telescoped within the outer tubular bar 58. The telescopic arrangement for the bars 30 and 32 of the first set may be provided at a first end 60 and 62 of bars 30 and 32 and optionally at a second end 64 and 66 of the same bars. In the optional circumstance, additional tubular bar 68 is telescoped within the outer tubular bar 54 and tubular bar 70 is telescoped within the tubular bar 58. The inner tubular bars 52 and 56 and correspondingly with those of 68 and 70 cannot be extended beyond the respective ends 60 and 62 and 64 and 66 of the outer bars 54 and 58 distances which exceed approximately the distance between adjacent vertical bars 34 and 36. It has been determined that the best spacing both vertically and horizontal between the first and second bar sets is approximately eight inches. An opening in excess of this size can make it easier for a burglar to manipulate either the window or the bar guard system and force entry. It is appreciated, however, that there are exceptions to this, such as with respect to the irregular shaped window as shown in FIG. 7 to be discussed.

Figure 6:
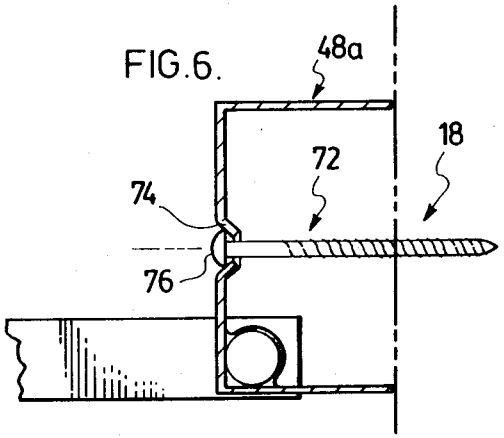
FIG. 6 is a section along the lines 6—6 of FIG. 5.

The first set of bars are retractable and extensible to fit the window size opening within the operative range of extending either or both of the extensible inner tubular portions of the first set of bars. With the first set of bars extended to reach the structural portions 18 and 20 of the building, the securing devices 48 and **48*a* may be secured to the building wall portions. According to this embodiment, non-removable fasteners 72 are used which extend through apertures 74 in the respective retaining devices 48 and 48*a*. The non-removable fasteners 72 consist of a screw threaded portion 64 and a case hardened head portion 76 having a one-way drive slot 78 formed therein. By way of the one-way drive slot, it is understood that a screwdriver may be used to screw the fastener 72 into the building wall portion. However, the head is formed with camming faces adjacent the slot which will not allow the screwdriver to obtain a grip on the head slot when rotated in the removal direction. Thus as shown in FIG. 6, the non-removable fastener 72 is threaded into the building wall portion 18 and the head 76 is countersunk in the aperture 74 of the retaining device 48*a* to ensure that the head 76 cannot be grasped with pliers or the like to attempt removal. It is appreciated that the fastener 72 may be used in conjunction with an expandable plug sunk in the wall for setting the fastener 72** therein should the fastener be formed of concrete or materials other than wood which cannot be easily penetrated by common wood screws.

According to this preferred embodiment, the second set of bars 34, 36, 38 and 40 may include extensible portions. For example with bar 38, it may have at its upper and lower ends 78 and 80 inner tubular bars 82 and 84 telescoped in the outer bar portion 86. This arrangement for the second set of bars provides for adjustment in the direction of the second set of bars to fill the gaps above and below the first set of bars. Pointed elements 88 may be secured to the upper portions 90 of the inner extensible bars 82.

With the grillwork 28 assembled and all extensible inner bars located within the outer bars, the securing devices 48 and **48*a* or 46 and 48 of FIG. 1 are secured against the building wall portions. For purposes of installing the bar grating, the system is essentially self-supporting due to the telescopic relationship of the inner and outer bars for the first set. As to the second set of bars, care has to be exercised with respect to the lower inner bars 84 to ensure that they are in place when the grill bar system is installed in the window opening. With reference to FIG. 3, an exemplary telescopic relationship of an outer bar 54 and inner tubular bar 52 is shown. The tubular bars 52 and 54** may be of a variety of cross-sections, although according to this embodiment for reasons of ornamental appeal and strength, the interfitting tubular bars are rectangular in cross-section.

The bars may be formed of a variety of rigid break resistant materials, such as plastics which include glass reinforced plastics and Nylon (trademark) and metals which include aluminum alloys and mild steel. The telescoping bars may be permanently secured together in a variety of ways which provide an interconnection between the tubular bars which is not readily broken by prying the grillwork with crowbars and the like. Adjacent wall portions of the telescoping tubular bars may be permanently secured by use of rivets which can be inserted through a bore drilled through adjacent wall portions of telescoping bars. The rivet is of the type which is secured in place by way of a special tool for crimping the rivet internally of the tube bars. With glass reinforced plastics, such as acrylic fiberglass compositions and nylon, the mating tubular bars may be secured with an appropriate adhesive which resists the environmental elements and which does not fail under pressure. The principal requirement in securing the tubular telescoping bars is that the handy man or householder is able to attend to the securing.

According to a feature of this invention, a device is provided which the householder and handy man can use to fix and permanently secure the relative positions of the telescoping bars. In this embodiment, the bars are formed of a metal which can be pierced, such as a structural grade of aluminum alloy or mild cold rolled steel. The piercing device 92 consists of a rigid clamp having a base 94 and upstanding opposing walls 96 and 98. The piercing device 92 may be formed of a high tensile steel. Upstanding wall 98 includes a threaded aperture 100 which is shown in FIG. 4. A bolt 102 is threaded into the aperture and has a case hardened conical shaped portion 104 for piercing the metal of the inner and outer bars 52 and 54. The bolt 102 includes a head portion 106 which can be engaged by a wrench. The piercing device 92 is positioned over the overlapping area of the inner and outer tubular bars 52 and 54 and placed against the base 94, as shown in FIG. 4. By threading the bolt 102 inwardly, the conical portion 104 pierces the adjacent overlapping wall portions **54*a* and 52*a*. By piercing the overlapping portions 52*a* and 54*a* of the telescoped tubular bars, crimped portions 108 and 110 are formed in the adjacent walls. Due to the piercing device 104 being conical, the circular opening defined by crimped portions 108 and 110 permanently secures the position of the inner bar 52 relative to the outer bar 54. It has been determined that this type of interconnection can withstand considerable forces exerted on the grillwork with a crowbar without failing. Upon piercing and thereby crimping the first set of bars at their respective end portions 60, 62, 64 and 66 of FIG. 5, the customized window grate is prepared which permanently spans the window opening 16**.

The second set of bars, in the event that they have telescoping members are similarly secured. As shown in FIG. 2, the inner tubular bar 82 is secured to the outer bar 86 by crimping at 112 The other inner tubular bar 84 is crimped at 114 to the outer tubular bar 86. In this manner, the positions of the upper and lower inner tubular bars 82 and 84 are fixed to properly fill the window opening 16. In view of the telescopic nature for both the first and second set of bars, the outer bars 86 of the second set are welded to the outer bars of the first set 54 and 58. According to this embodiment, the welding attachment is, for example, in the form of fillet welds 116.

As explained with respect to the shape of the sections of the tubular bars for purposes of strength and ornamentation, they are, according to this preferred embodiment, rectangular. It is appreciated, however, that the telescoping tubular bars may be of a variety of shapes, such as oval, circular or convoluted for purposes of additional structural strength and/or ornamentation. In the event that the piercing device 92 is used in permanently securing the telescoping portions together, the shape of the bars is selected to provide a surface through which the piercing device may extend. Preferably the telescoping tubular bars include adjacent planar wall portions extending along the respective inner and outer bars to provide a face through which the piercing device can be inserted.

With reference to FIG. 7, irregular shaped window openings 118 are readily accommodated by the window bar grill system according to this invention. The first set of spaced-apart bars 30 and 32 remain essentially the same. Their end portions 42 and 44 are secured by the respective retaining devices 48 and **48*a* to the opposing building structural portions 120 and 122 which defined opposing edges of the window opening 124. The second set of bars include inner extensible portions 82 which can be extended to varying heights to fill the space of the window opening 124 above the horizontal bar 32. By use of the piercing device 92, the arcuate building structural portion 126 is filled by varying heights of the inner extensible portions 82** of the second set of tubular telescopic members.

Figure 8:
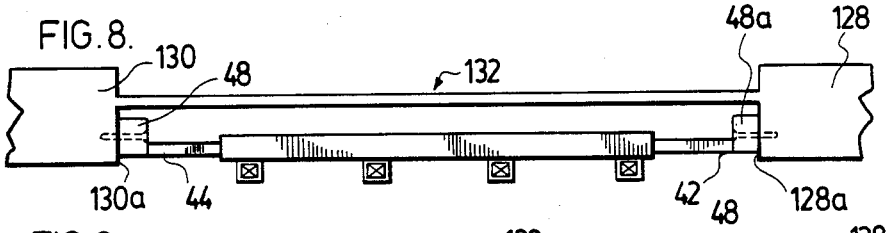
FIGS. 8 and 9 illustrate different embodiments for mounting of the window bar system to structural portions of a building which defines the window opening.
Figure 9:
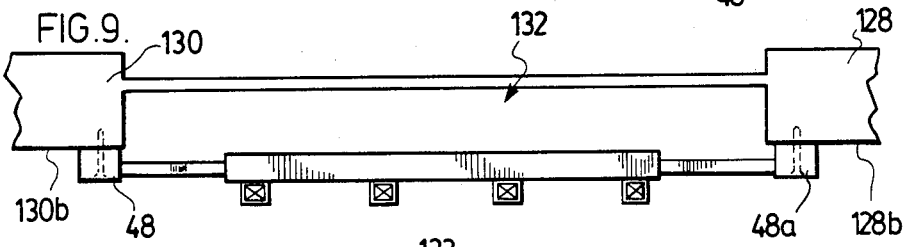

As shown in FIGS. 8 and 9 by way of pivotal connection of the securing devices 48 and **48*a* to the end portions 42 and 44 of the bar grill system, the securing devices may be located in a variety of orientations against varying slopes of the building structure 128 and 130 defining opposing edges of the window opening 132. In the embodiment of FIG. 8, the securing devices 48 and 48*a* are secured to the opposing wall portions 128*a* and 130*a*, whereas in FIG. 9 the securing devices 48 and 48*a* are pivoted so as to be fastened to the exterior wall portions 128*b* and 130*b*** of the building structure.

As noted with respect to FIG. 1, one of the securing devices may have a lock as at 50 in securing member 46. A unique key 134 may be used by the householder or owner of the building to release the lock and allow outward swinging of the bar guard system 28 in the direction of arrow 136 to the dotted position at **28*b*. The securing device 48 is formed in a manner to permit complete outward swinging of the bar guard system to the position 28*b*. In the event of fire, the householder may use a key located near the interior of the window opening 132** to permit unlocking of the bar guard system and permit immediate exit through the window.

Figure 10:
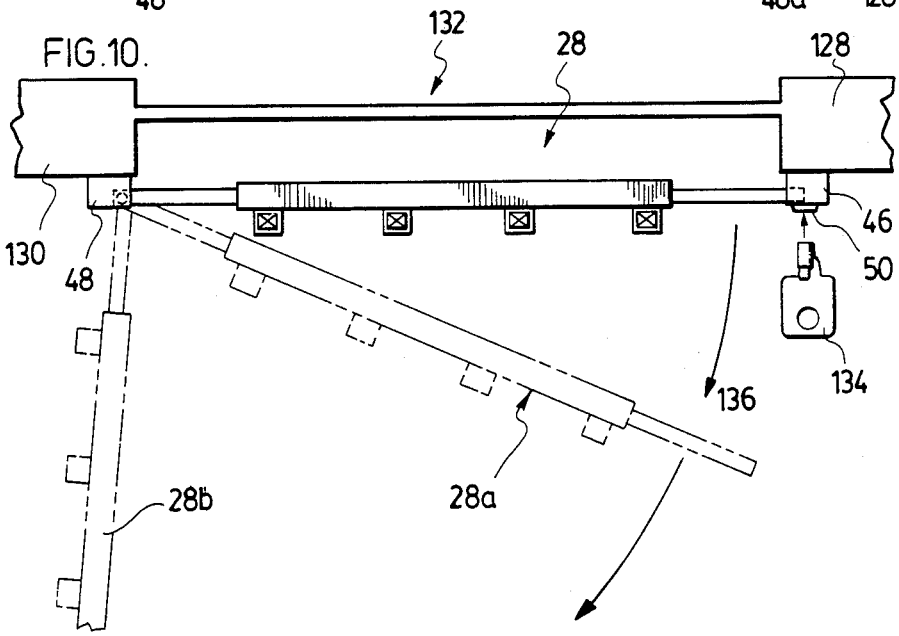
FIG. 10 shows the pivotal action of the window bar guard system having a lock arrangement for retaining the bar guard system in the closed position.

The pivotal connection of the end portion 42 and 44 to the securing devices 48 and **48*a* is shown in FIG. 12. For example, securing device 48 has the end portion 44 of the bar arrangement 32 pivotally connected internally of the metal enclosure for the securing device. The metal enclosure, according to this embodiment, consists of an outer wall 138 and depending side walls 140 and 142. The ends of the enclosure 48 are enclosed by end walls 144. An aperture 146 is formed in the enclosure 48. The end portion 44 of the bar 32 is inserted through the aperture 146 to interior of the enclosure 48. The end portion 44 has an aperture 148 formed therein which extends through opposing wall portions 150 and 152 of the inner tubular member 56. A pin 154 is placed through the aperture 148 and then secured to the interior walls of the enclosure 48 by weld 156. This arrangement thereby permanently secures the end portion 44 of the bar guard system within the enclosure to preclude unhinging of the bar guard system from the enclosure of the securing device 48. The aperture 146 is formed to extend through the outer wall 138 and side wall 142 to permit pivotal movement or hinging of the bar guard in the manner shown in FIG. 10**.

The lock system for the securing device 46 has a similar enclosure as with securing device 48. The enclosure is of metal having outer wall 154, opposing side walls 156 and 158 and upper and lower end walls 160. The lock 50 has a barrel portion 162 into which the key is inserted through the exterior in the manner shown in FIG. 10. The barrel has secured thereto a forked member 164 and a spacer disc 166 secured by nut 168. The barrel 162 is secured to the wall 154 by way of a U-shaped clip 171 which is only partly shown in FIG. 11.

FIGS. 13 and 14 illustrate the action of the forked member 164 moving the slide 170 up and down in the direction of arrow 172 By inserting the key 134 into the lock 50, it is possible to swing the forked member 164 in the direction of arrow 174. With the forked member 164 in the position shown in FIG. 13, the slide 170 is in its uppermost position as supported by leg 176 of the forked member 164 in opening 182. The washer 166 is eccentrically mounted with respect to the axis 178 of the barrel of the lock The washer 166 has its central axis 180 offset laterally of the lock barrel axis 178. This results in the washer 166 moving the slide 170 over against the interior portion of the wall 158.

To lock the system, the key 134 is rotated to swing the fork member 164 in the direction of arrow 174. In swinging the fork member 164 downwardly, the leg 186 is inserted in opening 184 to control the downward movement of the slide 170 to thereby lock up the grate end portion 44 in the retaining device 46.

With reference to FIG. 11, the respective inner bars 68 and 70 of the end portion 42 of the bar guard system are inserted through the apertures 188 and 190 of the metal enclosure. The washer 166 in moving the slide 170 against the wall portion 158 assists in aligning the respective slide pins 992 and 194 with the apertures 196 and 198 in the respective end portions of the inner tubular bars 68 and 70. With the pins 192 and 194 aligned with the apertures 196 and 198, the key is turned by rotating the barrel in the direction of arrow 174 of FIG. 14 to pass the pins through the apertures to lock the end portion 42 of the bar guard system in the retaining device 46. As the pins are passing downwardly through the apertures, increasing play develops in the movement of the slide 170 due to the eccentric mounting of the washer 166. As shown in FIG. 14, when the slide is in its lowermost position, a considerable space 200 is developed between the slide and the wall 158 to allow the pin portions 192 and 194 to move laterally whatever amount is needed to accommodate manufacturing tolerances in locating the apertures 196 and 198 in the end portions of the inner tube 68 and 70.

The apertures 188 and 190 are formed in the outer wall portion 154 and side wall portion 158 of the enclosure. The securing device 46 is always attached to the building structural portion in a manner to ensure that when the lock is released and the slide moved to its uppermost position, the bar end portions 68 and 70 can be swung outwardly of the enclosure by passing through the apertures 188 and 190 as the other end of the grillwork is pivoted about the other securing device 48. Due to the advantageous structure of pivotally mounting the securing devices 46 and 48 to the respective ends of the grillwork, the installer is assured of, in one way or another, positioning the locking enclosure 46 in a manner to permit the grillwork end portions to be swung inwardly and outwardly of the enclosure.

The window bar guard system, according to this invention, may be readily installed by the householder without requiring elaborate tools. Furthermore, it is appreciated that, according to a preferred embodiment, the piercing of the telescopic bar portions permanently secures them one relative to the other.

Although preferred embodiments of the invention are described herein in detail, it will be understood by one skilled in the art that variations may be made thereto without departing from the spirit of the invention or the scope of the appended claims.

The embodiments of the invention in which an exclusive property or privilege is claimed are defined as follows:

1. A window bar guard system for discouraging breaking and entry through a window, said system comprising a rigid bar grillwork having a plurality of spaced-apart first set of parallel bars and a plurality of interconnecting spaced-apart second set of parallel bars extending essentially perpendicular to said first set, said bar grillwork spanning a window opening to block human entry through the grillwork, means for securing opposite ends of said plurality of said first set of bars to corresponding structural portions defining opposing edges of a selected window opening, said plurality of said first set of bars each having a first tubular bar spanning a majority of the distance between said opposing window edges, a second tubular bar for telescopic insertion in an end portion of said first tubular bar, said first and second tubular bars having mating cross-sections, said second set of parallel bars being permanently secured to said first tubular bars of said first set of bars, said second tubular bars being operative for extended distances from within said first tubular bar of approximately the distance between spaced-apart bars of said second set, said second tubular bars being extended from said first tubular bars to span the remaining distance between said opposing window edges, means for permanently securing said second tubular bars to said first tubular bars after said first and second tubular bars are in their extended positions, said first and second tubular bars being formed of a metal selected from the group consisting of an aluminum alloy and steel, said means for permanently securing said tubular bars being formed by piercing adjacent wall portions of said first and second steel tubular bars to overlap thereby pierced sections of said adjacent wall portions, said overlapped wall portions permanently securing the relative telescopic positions of said first and second tubular bars, said second set of parallel bars comprising a plurality of third tubular bars, each of which is secured to said plurality of parallel first tubular bars, a fourth tubular bar for telescopic insertion in an open end portion of said third tubular bar, said third and fourth tubular bars having mating cross-sections with at least one pair of adjacent planar wall portions extending along said third and fourth tubular bars, said fourth tubular bars being operative for extended distances from within said third tubular bar of approximately the distance between spaced-apart bars of said first set, said fourth tubular bars being permanently secured to said third tubular bars after said third and fourth tubular bars are in their extended positions, said third and fourth tubular bars being formed of steel and being permanently secured by piercing said adjacent planar wall portions of said third and fourth steel tubular bars to overlap thereby pierced sections of said adjacent wall portions, said overlapped wall portions permanently securing the relative telescopic positions of said third and fourth tubular bars.

2. A window bar guard system of claim 1, wherein said fourth tubular bars are telescopically located in both open ends of each said third tubular bar to increase thereby the adjustability of said system to varying distances between edges of windows to be protected.

3. A window bar guard system for discouraging breaking and entry through a window, said system comprising a rigid bar grillwork having a plurality of spaced-apart first set of parallel bars and a plurality of interconnecting spaced-apart second set of parallel bars extending essentially perpendicular to said first set, said bar grillwork spanning a window opening to block human entry through the grillwork, means for securing opposite ends of said plurality of said first set of bars to corresponding structural portions defining opposing edges of a selected window opening, said plurality of said first set of bars each having a first tubular bar spanning a majority of the distance between said opposing window edges, a second tubular bar for telescopic insertion in an end portion of said first tubular bar, said first and second tubular bars having mating cross-sections, said second set of parallel bars being permanently secured to said first tubular bars of said first set of bars, said second tubular bars being operative for extended distances from within said first tubular bars of approximately the distance between spaced-apart bars of said second set, said second tubular bars being extended from said first tubular bars to span the remaining distance between said opposing window edges, means for permanently securing said second tubular bars to said first tubular bars after said first and second tubular bars are in their extended positions, said securing means being pivotally connected to said ends of said first set of parallel bars, non-removable fasteners attaching said securing means to structural portions defining opposing edges of a selected window opening, one of said securing means at an end of said first set of bars having means for releasably retaining end portions of said first set of bars in said securing means, said retaining means comprising a key actuated lock which in a first position locks said end portions of said first set of bars in said securing means and in a second position, as moved by a key, releases said end portions of said first set of bars from said securing means, said securing means comprises a rigid elongate metal enclosure having exterior wall portions, said wall portions having a plurality of spaced-apart aligned apertures through which said ends of first set of bars extend, said bar ends of said first set being pivotally mounted internally of said enclosure to said wall portions, said apertures extending in a direction for permitting movement of said enclosure relative to said grillwork, said retaining means for said bar end portions comprising a slide member for reciprocation in said enclosure across said apertures, said slide member having a pin associated therewith for each aperture, said lock operatively connected to said slide to reciprocate said slide, said pins being clear of said apertures in said lock second position to permit insertion of said bar end portions into said enclosure, said bar end portions having apertures which are in register with said pins, movement of said lock to said lock first position moving said slide to pass said pins through said apertures of said bar end portions to retain thereby said end of said first set of bars.

* * * * *